US005300167A

United States Patent [19]

Nohr et al.

[11] Patent Number: 5,300,167

[45] Date of Patent: Apr. 5, 1994

[54] METHOD OF PREPARING A NONWOVEN WEB HAVING DELAYED ANTIMICROBIAL ACTIVITY

[75] Inventors: Ronald S. Nohr, Roswell; John G. MacDonald, Decatur, both of Ga.

[73] Assignee: Kimberly-Clark, Neenah, Wis.

[21] Appl. No.: 76,528

[22] Filed: Jun. 11, 1993

Related U.S. Application Data

[63] Continuation-in-part of Ser. No. 817,271, Jan. 3, 1992, abandoned.

[51] Int. Cl.[5] ..... D04H 3/16

[52] U.S. Cl. ..... 156/167; 156/296

[58] Field of Search ..... 428/907; 514/642; 556/413; 414/443, 404; 156/62.2, 62.4, 62.6, 296, 167

[56] References Cited

U.S. PATENT DOCUMENTS

| | | | |
|---|---|---|---|
| 3,016,599 | 1/1962 | Perry . | |
| 3,341,394 | 9/1967 | Kinney . | |
| 3,624,120 | 11/1971 | Yetter | 556/425 |
| 3,655,862 | 4/1972 | Dorschner . | |
| 3,692,618 | 9/1972 | Dorschner . | |
| 3,704,198 | 11/1972 | Prentice . | |
| 3,705,068 | 12/1972 | Dobo . | |
| 3,755,527 | 8/1973 | Keller . | |
| 3,802,817 | 4/1974 | Matsuki . | |
| 3,849,241 | 11/1974 | Butin . | |
| 3,853,651 | 12/1974 | Porte . | |
| 3,978,185 | 8/1976 | Butin . | |
| 4,064,605 | 12/1977 | Akiyama . | |
| 4,091,140 | 5/1978 | Harmon . | |
| 4,100,319 | 7/1978 | Schwartz . | |
| 4,100,324 | 7/1978 | Anderson . | |
| 4,118,531 | 10/1978 | Hauser . | |
| 4,282,366 | 8/1981 | Eudy | 556/413 |
| 4,340,563 | 7/1982 | Appel . | |
| 4,405,297 | 9/1983 | Appel . | |
| 4,417,066 | 11/1983 | Westall | 556/425 |
| 4,434,204 | 2/1984 | Harman . | |
| 4,504,541 | 3/1985 | Yasuda et al. | 428/907 X |
| 4,627,811 | 12/1986 | Greiser . | |
| 4,644,045 | 2/1987 | Fowells . | |
| 4,663,220 | 5/1987 | Wisneski . | |
| 4,769,268 | 9/1988 | Burton | 428/907 X |
| 4,835,019 | 5/1989 | White et al. | 428/907 X |
| 4,895,917 | 1/1990 | Gruning . | |
| 4,895,964 | 1/1990 | Margida . | |
| 4,895,968 | 1/1990 | Buese . | |
| 4,923,914 | 5/1990 | Nohr . | |
| 5,145,596 | 9/1992 | Blank et al. | 252/8.7 X |

FOREIGN PATENT DOCUMENTS 1-197557 8/1989 Japan .

OTHER PUBLICATIONS

V. A. Wente, "Superfine Thermoplastic Fibers", vol. 48, No. 8, pp. 1342–1346 (1956).

V. A. Wente, et al., "Manufacture of Superfine Organic Fibers", NRL Report 4364 (111437), dated May 25, 1954.

Robert R. Butin & Dwight T. Lohkamp, "Melt Blowing-A One-Step Web Process for New Nonwoven Products", vol. 56, No. 4, pp. 74–77 (1973).

*Primary Examiner*—Jeff H. Aftergut

*Attorney, Agent, or Firm*—William E. Maycock

[57] ABSTRACT

A method of forming a nonwoven web having delayed antimicrobial activity, in that the web does not exhibit antimicrobial activity upon its formation but develops such activity within from about three hours to about 30 days thereafter without any post-formation treatment, which method involves the steps of (1) melting a mixture consisting of a thermoplastic polyolefin, an additive, and a retardant coadditive; (2) forming fibers by extruding the resulting melt through under defined conditions of shear and throughput; (3) drawing the fibers; and (4) collecting the fibers on a moving foraminous surface as a web of entangled fibers. The additive is a defined siloxane quaternary ammonium salt having a weight average molecular weight of from about 800 to about 2,000 and a polydispersity of up to about 3.0. The additive is present in an amount of from about 0.5 to about 2.0 percent by weight, based on the amount of thermoplastic polyolefin. The retardant coadditive is a high surface area particulate inorganic or organic material which is insoluble in the polymer at both ambient and melt-extrusion temperatures, is present in an amount of from about one-half to about two times the amount on a weight basis of the additive, has a surface area of from about 50 to about 500 $m^2$, and is capable of being at least partially being coated by the additive.

12 Claims, No Drawings

METHOD OF PREPARING A NONWOVEN WEB HAVING DELAYED ANTIMICROBIAL ACTIVITY

CROSS-REFERENCE TO RELATED APPLICATION

This application is a continuation-in-part of copending application Ser. No. 07/817,271, filed Jan. 3, 1992, now abandoned.

Antimicrobial siloxane quaternary ammonium salts are described and claimed in copending and commonly assigned application Ser. No. 08/076,529 filed of even date in the names of Ronald Sinclair Nohr and John Gavin MacDonald.

BACKGROUND OF THE INVENTION

The present invention relates to the formation of a nonwoven web by melt extrusion.

Traditional melt-extrusion processes for the formation of a nonwoven web from a thermoplastic polymer typically involve melting the thermoplastic polymer, extruding the molten polymer through a plurality of orifices to form a plurality of threadlines or filaments, attenuating the filaments by entrainment in a rapidly moving first stream of gas, cooling the filaments with a second stream of gas, and randomly depositing the attenuated filaments, or fibers, on a moving foraminous surface. The most common and well known of these processes are meltblowing, coforming, and spunbonding. The nonwoven webs obtained by these processes are widely used in a variety of products, but especially in such disposable absorbent products as diapers; incontinent products; feminine care products, such as tampons and sanitary napkins; wipes; sterilization wraps; surgical drapes and related materials; hospital gowns, shoe covers, and the like, to name but a few.

Meltblowing references include, by way of example, U.S. Pat. Nos. 3,016,599 to R. W. Perry, Jr., 3,704,198 to J. S. Prentice, 3,755,527 to J. P. Keller et al., 3,849,241 to R. R. Butin et al., 3,978,185 to R. R. Butin et al., and 4,663,220 to T. J. Wisneski et al. See, also, V. A. Wente, "Superfine Thermoplastic Fibers", *Industrial and Engineering Chemistry*, Vol. 48, No. 8, pp. 1342–1346 (1956); V. A. Wente et al., "Manufacture of Superfine Organic Fibers", Navy Research Laboratory, Washington, D.C., NRL Report 4364 (111437), dated May 25, 1954, United States Department of Commerce, Office of Technical Services; and Robert R. Butin and Dwight T. Lohkamp, "Melt Blowing—A One-Step Web Process for New Nonwoven Products", *Journal of the Technical Association of the Pulp and Paper Industry*, Vol. 56, No. 4, pp. 74–77 (1973).

Conforming references (i.e., references disclosing a meltblowing process in which fibers or particles are comingled with the meltblown fibers as they are formed) include U.S. Pat. Nos. 4,100,324 to R. A. Anderson et al. and 4,118,531 to E. R. Hauser.

Finally, spunbonding references include, among others, U.S. Pat. Nos. 3,341,394 to Kinney, 3,655,862 to Dorschner et al., 3,692,618 to Dorschner et al., 3,705,068 to Dobo et al., 3,802,817 to Matsuki et al., 3,853,651 to Porte, 4,064,605 to Akiyama et al., 4,091,140 to Harmon, 4,100,319 to Schwartz 4,340,563 to Appel and Morman, 4,405,297 to Appel and Morman, 4,434,204 to Hartman et al., 4,627,811 to Greiser and Wagner, and 4,644,045 to Fowells.

U.S. Pat. No. 4,923,914 to Nohr et al., which is incorporated herein by reference, describes a means of altering the surface characteristics of fibers prepared from a thermoplastic polymer, such as a polyolefin. Although various surface characteristics are described, the patent clearly emphasizes converting normally hydrophobic surfaces to hydrophilic surfaces. The patent describes a surface-segregatable, melt-extrudable thermoplastic composition which comprises at least one thermoplastic polymer and at least one defined additive. The most preferred additives are polysiloxane polyethers which render the surfaces of the fibers hydrophilic.

Upon being melt-extruded, the compositions of U.S. Pat. No. 4,923,914 result in fibers having a differential, increasing concentration of the additive from the centers to the surfaces thereof, such that the concentration of additive toward the surface of each fiber is greater than the average concentration of additive in the more central region of the fiber and imparts to the surface of the fiber at least one desired characteristic which otherwise would not be present. The additive forms an emulsion with the polymer at melt extrusion temperatures, under which conditions the additive and the polymer form a metastable solution. As the temperature of the newly formed fiber drops below melt extrusion temperatures, the additive becomes significantly less compatible with the polymer. Concurrent with this marked change in compatibility, the polymer begins to solidify. Both factors contribute to the rapid migration or segregation of the additive toward the surface which takes place in a controllable manner.

Web integrity sometimes is a problem with the compositions of U.S. Pat. No. 4,923,914. When the additive is a siloxane-containing compound and the desired characteristic is water-wettability, the resulting nonwoven webs can lack integrity upon their formation because of the presence of additive on the surfaces of the fibers. The additive sometimes interferes with the fiber-to-fiber bonding upon which web integrity relies, especially at additive levels of about 1.5 weight percent or higher. In such circumstances, the additive also has a tendency to accumulate over time on the forming wire.

This problem of poor web integrity in nonwoven webs prepared such processes as meltblowing, coforming, and spunbonding can be rectified by instituting process changes. Alternatively, wettability can be delayed as described in application Ser. No. 07/566,938, entitled METHOD OF PREPARING A NONWOVEN WEB HAVING DELAYED WETTABILITY and filed on Aug. 13, 1990 in the names of Ronald S. Nohr and J. Gavin MacDonald. The delay in wettability results from the use of a trisiloxane polyether having the general formula,

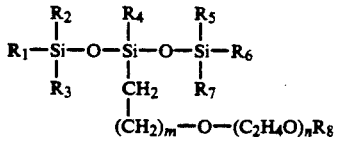

in which:

(a) $R_1$–$R_7$ are independently selected monovalent $C_1$–$C_3$ alkyl groups;

(b) $R_8$ is hydrogen or a monovalent $C_1$–$C_3$ alkyl group;

(c) m represents an integer of from 0 to about 5;

(d) n represents an integer of from 0 to about 8;

(e) the molecular weight is from about 350 to about 700;

(f) the polydispersity is from about 1.0 to about 1.3; and (g) the trisiloxane polyether is present in an amount of from about 0.5 to about 1.75 percent by weight, based on the amount of thermoplastic polymer, which amount, if homogeneously distributed throughout the polyolefin, is not sufficient to render the polyolefin wettable by water.

A method of increasing the wettability delay period of the nonwoven webs obtained in cross-referenced application Ser. No. 07/566,938 is disclosed in application Ser. No. 07/488,344, filed on Mar. 2, 1990 in the names of Ronald S. Nohr and J. Gavin MacDonald, now U.S. Pat. No. 5,114,636. Such increase in the delay period results from including in the thermoplastic composition, in addition to the defined trisiloxane polyether, from about 0.1 to about 6 percent by weight, based on the amount of thermoplastic polymer, of at least one material having the capacity to increase the delay period for up to about two weeks. The preferred material for increasing the delay period is a phthalocyanine dye.

Previous attempts to apply the teachings of U.S. Pat. No. 4,923,914 to the preparation of nonwoven webs having antimicrobial activity were not successful. Moreover, the difficulties were deemed to be of such as nature that they could not be corrected by means of the teachings of application Ser. Nos. 07/566,938 and 07/488,344.

SUMMARY OF THE INVENTION

It therefore is an object of the present invention to provide a method of forming a nonwoven web having delayed antimicrobial activity.

This and other objects will be apparent to those having ordinary skill in the art from a consideration of the specification and claims which follow.

Accordingly, the present invention provides a method of forming a nonwoven web having delayed antimicrobial activity, in that said web does not exhibit antimicrobial activity upon its formation but develops such activity within from about three hours to about 30 days thereafter without any post-formation treatment, which method comprises the steps of:

(A) melting a mixture which comprises a thermoplastic polyolefin, an additive, and a retardant coadditive;

(B) forming fibers by extruding the resulting melt through a die at a shear rate of from about 50 to about 30,000 $sec^{-1}$ and a throughput of no more than about 5.4 kg/cm/hour;

(C) drawing said fibers; and (D) collecting said fibers on a moving foraminous surface as a web of entangled fibers;

in which:

(1) said additive has the general formula,

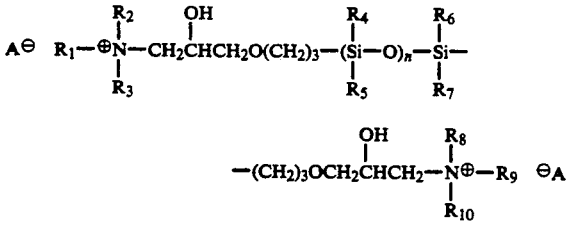

in which:

(a) $R_2$–$R_8$ and $R_{10}$ are independently selected monovalent $C_1$–$C_3$ alkyl groups;

(b) $R_1$ and $R_9$ are independently selected monovalent $C_6$–$C_{25}$ alkyl groups;

(c) A represents a monovalent anion;

(d) n represents an integer of from 1 to about 20;

(e) said additive has a molecular weight of from about 800 to about 2,000;

(f) said additive has a polydispersity of up to about 3.0; and (g) said additive is present in an amount of from about 0.5 to about 2 percent by weight, based on the amount of thermoplastic polyolefin; and (2) said retardant coadditive is a high surface area particulate inorganic or organic material, which retardant coadditive:

(a) is insoluble in the polymer at both ambient and melt-extrusion temperatures;

(b) is present in an amount of from about one-half to about two times the amount on a weight basis of said additive;

(c) has a surface area of from about 50 to about 1,000 $M^2$; and (d) is capable of being at least partially coated by said additive.

In certain embodiments, the polyolefin in polypropylene. In other embodiments, the additive molecular weight is in the range of from about 800 to about 1,200, with a typical molecular weight being about 1,000.

Once the antimicrobial activity has developed, the nonwoven web is capable of killing greater than 80 percent of both gram-negative and gram-positive bacteria.

DETAILED DESCRIPTION OF THE INVENTION

As used herein, the term "delayed antimicrobial activity" as applied to a nonwoven web means that the web does not exhibit antimicrobial activity upon its formation but develops such activity within from about three hours to about 30 days thereafter without any post-formation treatment.

The term "post-formation treatment" means any process step or treatment of any kind after the fibers have been formed and collected as a nonwoven web on the moving foraminous surface, which process step or treatment is required in order to induce antimicrobial activity. Thus, in the absence of a post-formation treatment, antimicrobial activity develops spontaneously after a given period of time.

In general, the term "thermoplastic polyolefin" is used herein to mean any thermoplastic polyolefin which can be used for the preparation of nonwoven webs. Examples of thermoplastic polyolefins include polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly(vinylidene chloride), polystyrene, and the like.

In certain embodiments, the polyolefins are those which contain only hydrogen and carbon atoms and which are prepared by the addition polymerization of one or more unsaturated monomers. Examples of such polyolefins include, among others, polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polystyrene, and the like. In addition, such term is meant to include blends of two or more polyolefins and random and block copolymers prepared from two or more different unsaturated monomers. Because of their commercial importance, the most significant polyolefins are polyethylene and polypropylene.

The additive which is employed in the method of the present invention is a siloxane quaternary ammonium salt having the formula,

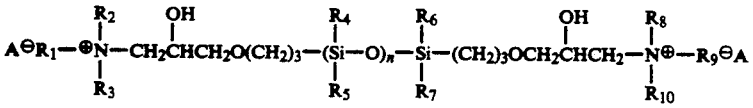

in which:

(a) $R_2$–$R_8$ and $R_{10}$ are independently selected monovalent $C_1$–$C_3$ alkyl groups;
(b) $R_1$ and $R_9$ are independently selected monovalent $C_6$–$C_{25}$ alkyl groups;
(c) A represents a monovalent anion;
(d) n represents an integer of from 1 to about 20;
(e) said additive has a weight average molecular weight of from about 800 to about 2,000; and
(f) said additive has a polydispersity of up to about 3.0.

In some embodiments, each of $R_2$–$R_8$ and $R_{10}$ is a methyl group. In other embodiments, $R_1$ and $R_9$ independently are monovalent $C_{12}$–$C_{18}$ alkyl groups. In yet other embodiments, n is an integer from about 6 to about 10. In still other embodiments, A is a halide, with chloride being most typical.

While the additive weight average molecular weight can vary from about 800 to about 2,000, it typically will be in the range of from about 800 to about 1,200. A weight average molecular weight of about 1,000 is perhaps most exemplary of the additive.

As noted, the polydispersity of the additive will be up to about 3.0. As used herein, the term "polydispersity" refers to the ratio of the weight average molecular weight to the number average molecular weight. In certain embodiments, the polydispersity of the additive will be in the range of from 1.3 to about 1.8.

In general, the additive will be present in an amount of from about 0.5 to about 2 percent by weight, based on the amount of thermoplastic polyolefin. In some embodiments, the amount of additive will be in the range of from about 0.8 to about 1.2 percent by weight.

The term "additive" is used broadly herein to encompass the use of more than one additive in a given composition, i.e., a mixture of two or more additives. Moreover, it should be appreciated by those having ordinary skill in the art that additives as defined herein typically are not available as pure compounds. Thus, the presence of impurities or related materials which may not come within the general formula given above for the additives does remove any given material from the spirit and scope of the present invention.

In general, the additive is either commercially available or readily prepared by those having ordinary skill in the art by known methods.

In addition to the additive, the thermoplastic polyolefin to be meltprocessed to form a nonwoven web includes a retardant coadditive which is a high surface area particulate inorganic or organic material. This retardant coadditive (a) is insoluble in the polymer at both ambient and melt-extrusion temperatures; (b) has a surface area of from about 50 to about 1,000 $m^2$; and (c) is capable of being at least partially coated by the additive.

The retardant coadditive typically is present in an amount equal to from about one-half to about two times the amount on a weight basis of additive employed. The retardant coadditive can be any inorganic or organic material having the requisite surface area. In addition, the retardant coadditive should be stable under melt-extrusion conditions. Moreover, the retardant coadditive should be capable of being at least partially coated by the additive. Stated differently, the additive typically will have a surface tension which is less than the surface free energy of the retardant coadditive particles.

In general, the shear rate required by the method of the present invention will be in the range of from about 50 to about 30,000 $sec^{-1}$. Typically, the shear rate will be in the range of from about 150 to about 5,000 $sec^{-1}$, and most typically from about 300 to about 2,000 $sec^{-1}$.

Throughput is of importance because it affects the time the newly formed fiber or film is in a sufficiently molten or fluid state to allow migration or segregation of the additive toward the newly formed surfaces, even though throughput also affects the shear rate.

Throughput typically will be in the range of from about 0.01 to about 5.4 kg/cm/hour. More typically, throughput will be in the range from about 0.1 to about 4.0 kg/cm.hour. The throughput most typically will be in the range of from about 0.5 to about 2.5 kg/cm/hour.

Without wishing to be bound by theory, it is believed that the additives emulsify readily in a polyolefin such as polypropylene to form micelle structures or aggregates. However, additives with weight average molecular weights below about 1,400 form thermally unstable aggregates. That is, the lower the weight average molecular weight of the additive, the more thermally unstable are the micelle structures. At fiber process conditions at temperatures above about 170° C., such additives with weight average molecular weights of around 600–700 readily "break apart" from their poorly packed aggregate structures. The additives then are able to diffuse to the newly forming fiber surfaces.

However, the lower molecular weight components, in the total molecular weight distribution, not only break apart more readily from their micelle structures at temperature above about 170° C., but they also are capable of diffusing more rapidly than the higher molecular weight species. Thus, the molecular weight distribution or polydispersity requirement is central to the present invention. That is, it is essential that the additive have a relatively high polydispersity in order to minimize the amounts of lower molecular weight components.

In other words, broad molecular weight dispersions contain molecular species that will migrate to the fiber surfaces long after the fibers have been formed. In order to avoid spontaneous surface segregation of low molecular weight species, larger concentrations of higher molecular weight species are required. Segregation control and to some extent, synthetic realities, require broad molecular weight dispersions or polydispersities in concert with higher additive concentrations.

While the additive still tends to migrate to the surfaces of the fibers, the rate of migration is slower because the higher molecular weight components diffuse more slowly than the lower molecular weight components. Moreover, the diffusion or migration of all components of the additive are delayed by the retardant coadditive. It is believed that the delay results from a temporary affinity of the additive for the surfaces of the retardant coadditive particles. Consequently, the retardant coadditive must have a relatively high surface area in order to affect essentially all of the additive.

Having thus described the invention, numerous changes and modifications thereof will be readily apparent to those having ordinary skill in the art without departing from the spirit or scope of the invention.

What is claimed is:

1. A method of forming a nonwoven web having delayed antimicrobial activity, in that said web does not exhibit antimicrobial activity upon its formation but develops such activity within from about three hours to about 30 days thereafter without any post-formation treatment, which method comprises the steps of:

(A) melting a mixture which comprises a thermoplastic polyolefin, an additive, and a retardant coadditive;

(B) forming fibers by extruding the resulting melt through a die at a shear rate of from about 50 to about 30,000 $sec^{-1}$ and a throughput of no more than about 5.4 kg/cm/hour;

(C) drawing said fibers; and (D) collecting said fibers on a moving foraminous surface as a web of entangled fibers;

in which:

(1) said additive has the general formula,

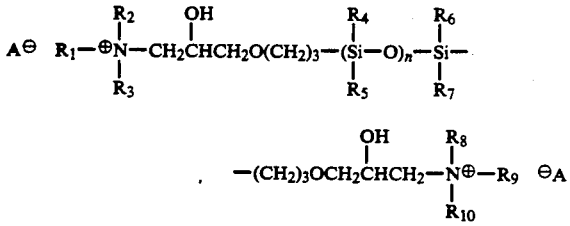

in which:

(a) $R_2$–$R_8$ and $R_{10}$ are independently selected monovalent $C_1$–$C_3$ alkyl groups;

(b) $R_1$ and $R_9$ are independently selected monovalent $C_6$–$C_{25}$ alkyl groups;

(c) A represents a monovalent anion;

(d) n represents an integer of from 1 to about 20;

(e) said additive has a weight average molecular weight of from about 800 to about 2,000;

(f) said additive has a polydispersity of up to about 3.0; and (g) said additive is present in an amount of from about 0.5 to about 2 percent by weight, based on the amount of thermoplastic polyolefin; and (2) said retardant coadditive is a high surface area particulate inorganic or organic material, which retardant coadditive:

(a) is insoluble in the polymer at both ambient and melt-extrusion temperatures;

(b) is present in an amount of from about one-half to about two times the amount on a weight basis of said additive;

(c) has a surface area of from about 50 to about 1,000 $m^2$; and (d) is capable of being at least partially coated by said additive.

2. The method of claim 1, in which said polyolefin is polypropylene.

3. The method of claim 1, in which said additive has a weight average molecular weight of from about 800 to about 1,200.

4. The method of claim 1, in which said additive is present in an amount of from about 0.8 to about 1.2 percent by weight, based on the amount of thermoplastic polymer.

5. The method of claim 1, in which each of $R_2$–$R_8$ and $R_{10}$ is a methyl group.

6. The method of claim 1, in which $R_1$ and $R_9$ independently are monovalent $C_{12}$–$C_{18}$ alkyl groups.

7. The method of claim 1, in which n is an integer from about 6 to about 10.

8. The method of claim 1, in which A is a halide.

9. The method of claim 8, in which A is chloride.

10. The method of claim 1, in which the shear rate is from about 150 to about 5,000 $sec^{-1}$.

11. The method of claim 1, in which the throughput is in the range of from about 0.1 to about 4.0 kg/cm/hour.

12. The method of claim 1, in which the additive, additive weight average molecular weight, additive polydispersity, additive concentration, retardant coadditive, and retardant coadditive concentration are selected so as to give a predetermined delay time.

* * * * *